US011621510B2

(12) United States Patent
Guo

(10) Patent No.: US 11,621,510 B2
(45) Date of Patent: Apr. 4, 2023

(54) CONNECTOR ASSEMBLY

(71) Applicant: DONGGUAN LUXSHARE TECHNOLOGIES CO., LTD, Dongguan (CN)

(72) Inventor: Rongzhe Guo, Dongguan (CN)

(73) Assignee: DONGGUAN LUXSHARE TECHNOLOGIES CO., LTD, Dongguan (CN)

( * ) Notice: Subject to any disclaimer, the term of this patent is extended or adjusted under 35 U.S.C. 154(b) by 151 days.

(21) Appl. No.: 17/232,951

(22) Filed: Apr. 16, 2021

(65) Prior Publication Data

US 2021/0376507 A1 Dec. 2, 2021

(30) Foreign Application Priority Data

May 29, 2020 (CN) ..... 202010482865.1

(51) Int. Cl.
*H01R 13/627* (2006.01)
*H01R 12/71* (2011.01)
(Continued)

(52) U.S. Cl.
CPC ..... *H01R 12/716* (2013.01); *H01R 12/777* (2013.01); *H01R 13/113* (2013.01);
(Continued)

(58) Field of Classification Search
CPC .. H01R 12/716; H01R 12/777; H01R 13/113; H01R 13/40; H01R 13/502;
(Continued)

(56) References Cited

U.S. PATENT DOCUMENTS 11,211,744 B2 * 12/2021 Zhu ..... H01R 12/7005
2005/0142949 A1 * 6/2005 Fang ..... H01R 12/721 439/630

(Continued)

FOREIGN PATENT DOCUMENTS

CN 102377044 A 3/2012
CN 105261891 A 1/2016

(Continued)

*Primary Examiner* — Abdullah A Riyami
*Assistant Examiner* — Nelson R. Burgos-Guntin
(74) *Attorney, Agent, or Firm* — Birch, Stewart, Kolasch & Birch, LLP

(57) ABSTRACT

A connector assembly includes a circuit board, a mounting bracket and a cable connector. The circuit board has a number of conductive pads. The cable connector includes an insulating body, a number of conductive terminals and cables. The insulating body includes a mounting surface. Each conductive terminal includes an elastic contact portion. The mounting bracket includes a frame portion and an installation space enclosed by the frame portion. The cable connector is at least partially received in the installation space so that the elastic contact portions are in contact with the conductive pads. Compared with the prior art, the present disclosure directly installs the cable connector on the circuit board by setting the mounting bracket, thereby omitting the socket connector and reducing the volume of the connector assembly.

18 Claims, 10 Drawing Sheets

(51) Int. Cl.

| | |
|---|---|
| ***H01R 12/77*** | (2011.01) |
| ***H01R 13/11*** | (2006.01) |
| ***H01R 13/40*** | (2006.01) |
| ***H01R 13/502*** | (2006.01) |
| ***H01R 13/629*** | (2006.01) |
| ***H01R 13/639*** | (2006.01) |

(52) U.S. Cl.
CPC ..... *H01R 13/40* (2013.01); *H01R 13/502* (2013.01); *H01R 13/629* (2013.01); *H01R 13/639* (2013.01)

(58) Field of Classification Search
CPC .. H01R 13/629; H01R 13/639; H01R 13/516; H01R 13/6581
See application file for complete search history.

(56) References Cited

U.S. PATENT DOCUMENTS

| | | | | |
|---|---|---|---|---|
| 2010/0210130 | A1* | 8/2010 | Yamaji | H01R 12/79 439/352 |
| 2012/0225591 | A1* | 9/2012 | Hung | H01R 12/59 439/692 |
| 2018/0233855 | A1* | 8/2018 | Phillips | H01R 13/6335 |
| 2020/0083627 | A1* | 3/2020 | Peloza | H01R 13/6471 |
| 2020/0169019 | A1* | 5/2020 | Cheng | H01R 12/724 |
| 2021/0075159 | A1* | 3/2021 | Wang | H01R 13/6582 |
| 2021/0126404 | A1* | 4/2021 | Laurx | H01R 12/716 |
| 2021/0135402 | A1* | 5/2021 | Li | H01R 13/6335 |
| 2021/0344142 | A1* | 11/2021 | Chang | H01R 13/6272 |
| 2021/0376507 | A1* | 12/2021 | Guo | H01R 13/113 |
| 2022/0045459 | A1* | 2/2022 | Lin | H01R 13/055 |

FOREIGN PATENT DOCUMENTS

| | | | |
|---|---|---|---|
| CN | 106159564 | A | 11/2016 |
| CN | 107275842 | A | 10/2017 |
| CN | 109103647 | A | 12/2018 |
| CN | 108631101 | B | 11/2019 |
| CN | 110808489 | A | 2/2020 |
| FR | 2 911 726 | A1 | 7/2008 |
| TW | 201820710 | A | 6/2018 |
| TW | 202017254 | A | 5/2020 |

* cited by examiner

CONNECTOR ASSEMBLY

CROSS-REFERENCE TO RELATED APPLICATION

This patent application claims priority of a Chinese Patent Application No. 202010482865.1, filed on May 29, 2020 and titled "CONNECTOR ASSEMBLY", the entire content of which is incorporated herein by reference.

TECHNICAL FIELD

The present disclosure relates to a connector assembly, which belongs to a technical field of connectors.

BACKGROUND

Existing connector assemblies usually include a socket connector for being mounted on a circuit board and a plug connector to mate with the socket connector. The circuit board is usually provided with a plurality of conductive pads, and the socket connector is provided with a plurality of soldering portions welded to the conductive pads.

As products demand higher and higher data transmission quality and speed, the loss of circuit boards has become a bottleneck. In addition, in the prior art, it is difficult to meet the requirements of miniaturization through the mating of the socket connector and the plug connector.

SUMMARY

An object of the present disclosure is to provide a connector assembly with a smaller volume.

In order to achieve the above object, the present disclosure adopts the following technical solution: a connector assembly, comprising: a circuit board having a plurality of conductive pads; a cable connector comprising an insulating body, a plurality of conductive terminals and a plurality of cables connected to the conductive terminals, the insulating body comprising a mounting surface facing the circuit board, each conductive terminal comprising an elastic contact portion protruding beyond the mounting surface; and a mounting bracket fixed to the circuit board, the mounting bracket comprising a frame portion and an installation space at least partially enclosed by the frame portion; wherein the cable connector is at least partially received in the installation space so that the elastic contact portions are in contact with the conductive pads.

In order to achieve the above object, the present disclosure adopts the following technical solution: a connector assembly, comprising: a circuit board having a plurality of conductive pads; a cable connector comprising an insulating body, a plurality of conductive terminals and a plurality of cables electrically connected with the conductive terminals, the insulating body comprising a mounting surface facing the circuit board, each conductive terminal comprising an elastic contact portion protruding beyond the mounting surface; and a mounting bracket fixed to the circuit board, the mounting bracket comprising a frame portion and an installation space at least partially enclosed by the frame portion; wherein the cable connector is at least partially mounted into the installation space along a first direction so that the elastic contact portions are in contact with the conductive pads; wherein the cable connector comprises a slider slidable along a second direction perpendicular to the first direction, and the slider is slidable relative to the insulating body between a locking position where the cable connector is locked by the mounting bracket and an unlocking position where the cable connector is separable from the mounting bracket.

Compared with the prior art, the present disclosure directly installs the cable connector to the circuit board by setting the mounting bracket, thereby omitting the socket connector and reducing the volume of the connector assembly.

DETAILED DESCRIPTION

Figure 1:
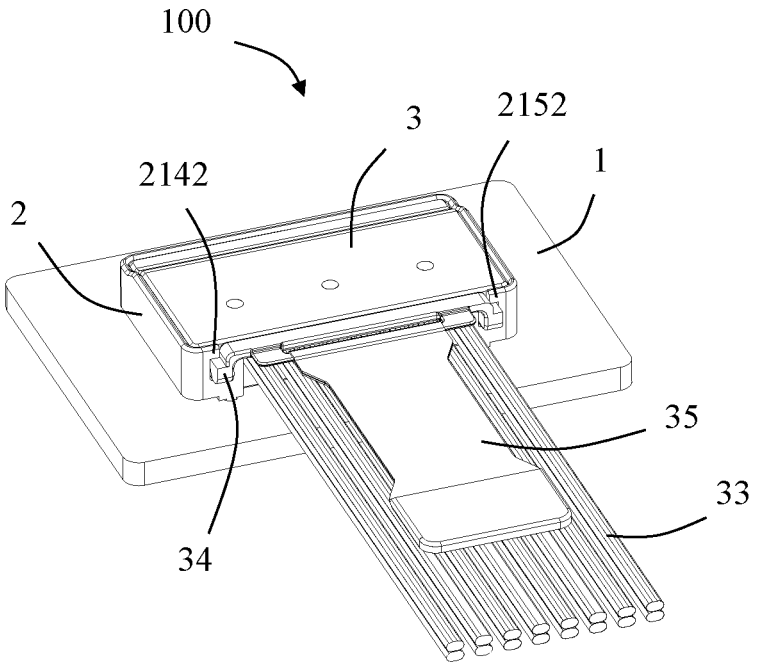
FIG. 1 is a perspective schematic view of a connector assembly in accordance with an illustrated embodiment of the present disclosure.

Exemplary embodiments will be described in detail here, examples of which are shown in drawings. When referring to the drawings below, unless otherwise indicated, same numerals in different drawings represent the same or similar elements. The examples described in the following exemplary embodiments do not represent all embodiments consistent with this application. Rather, they are merely examples of devices and methods consistent with some aspects of the application as detailed in the appended claims.

The terminology used in this application is only for the purpose of describing particular embodiments, and is not intended to limit this application. The singular forms "a", "said", and "the" used in this application and the appended claims are also intended to include plural forms unless the context clearly indicates other meanings.

It should be understood that the terms "first", "second" and similar words used in the specification and claims of this application do not represent any order, quantity or importance, but are only used to distinguish different components. Similarly, "an" or "a" and other similar words do not mean a quantity limit, but mean that there is at least one; "multiple" or "a plurality of" means two or more than two. Unless otherwise noted, "front", "rear", "lower" and/or "upper" and similar words are for ease of description only and are not limited to one location or one spatial orientation. Similar words such as "include" or "comprise" mean that elements or objects appear before "include" or "comprise" cover elements or objects listed after "include" or "comprise" and their equivalents, and do not exclude other elements or objects. The term "a plurality of" mentioned in the present disclosure includes two or more.

Hereinafter, some embodiments of the present disclosure will be described in detail with reference to the accompanying drawings. In the case of no conflict, the following embodiments and features in the embodiments can be combined with each other.

Figure 2:
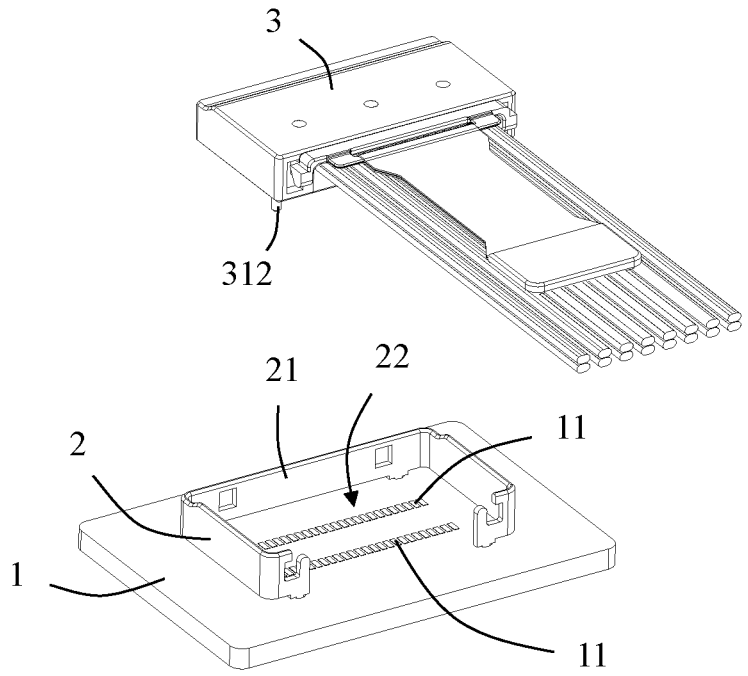
FIG. 2 is a partial perspective exploded view of FIG. 1.
Figure 3:
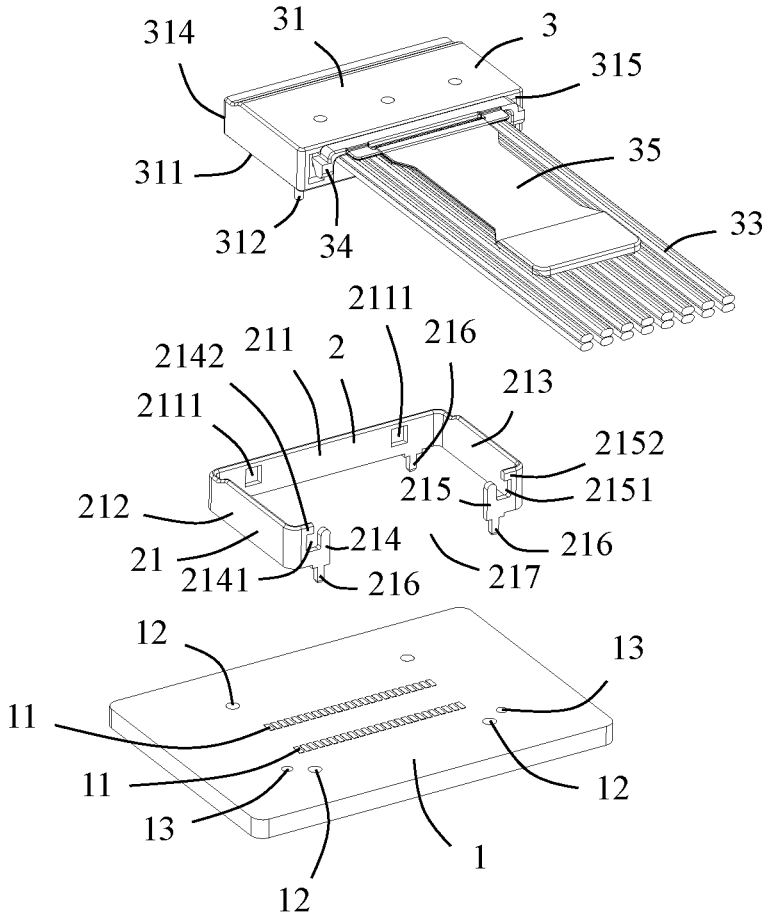
FIG. 3 is a further perspective exploded view of FIG. 2.

Referring to FIGS. 1 and 2, an embodiment of the present disclosure discloses a connector assembly 100 including a circuit board 1, a mounting bracket 2 fixed to the circuit board 1, and a cable connector 3. The cable connector 3 is at least partially received in the mounting bracket 2 and is in electrical contact with the circuit board 1.

Referring to FIGS. 1 to 4, the circuit board 1 has a plurality of conductive pads 11, a plurality of mounting holes 12 for fixing the mounting bracket 2 and a plurality of positioning holes 13 for positioning the cable connector 3. In the illustrated embodiment of the present disclosure, the conductive pads 11 are disposed in two parallel rows.

The mounting bracket 2 includes a frame portion 21 and an installation space 22 at least partially enclosed by the frame portion 21. In the illustrated embodiment of the present disclosure, the mounting bracket 2 is formed by stamping and bending a metal sheet. The cable connector 3 is at least partially received in installation space 22 along a first direction, i.e., a top-to-bottom direction. The frame portion 21 includes a first side wall 211, a second side wall 212 vertically bent from one side of the first side wall 211, a third side wall 213 vertically bent from the other side of the first side wall 211, a first extension wall 214 extending from the second side wall 212, and a second extension wall 215 extending from the third side wall 213. In the illustrated embodiment of the present disclosure, the first side wall 211, the second side wall 212 and the third side wall 213 together form a substantially U-shaped configuration. The first extension wall 214 and the second extension wall 215 extend opposite to each other. The first side wall 211 has two through holes 2111 spaced apart from each other. In addition, the first side wall 211, the first extension wall 214 and the second extension wall 215 respectively include at least one mounting portion 216 extending downwardly from lower edges thereof. When the mounting bracket 2 is mounted to the circuit board 1, the mounting portions 216 extend through the mounting holes 12 and are fixed to the circuit board 1 by welding or the like.

In addition, the first extension wall 214 includes a first locking opening 2141 and a first stopper 2142 located above the first locking opening 2141. Similarly, the second extension wall 215 includes a second locking opening 2151 and a second stopper 2152 located above the second locking opening 2151. In the illustrated embodiment of the present disclosure, the frame portion 21 is non-closed and includes an opening 217 located between the first extension wall 214 and the second extension wall 215. The first extension wall 214 and the second extension wall 215 are symmetrically arranged on both sides of the opening 217.

Referring to FIGS. 5 to 10, the cable connector 3 includes an insulating body 31, a plurality of conductive terminals 32, a plurality of cables 33 connected to the conductive terminals 32, a slider 34 and a force applying component 35 connected to the slider 34. The slider 34 is slidable relative to the insulating body 31 along a second direction (i.e., a front-to-back direction) perpendicular to the first direction. In the illustrated embodiment of the present disclosure, the conductive terminals 32 are divided into two groups which are respectively insert-molded with insulating blocks 361 so as to form two terminal modules 30. The insulating body 31 is over-molded on the terminal modules 30.

Figure 4:
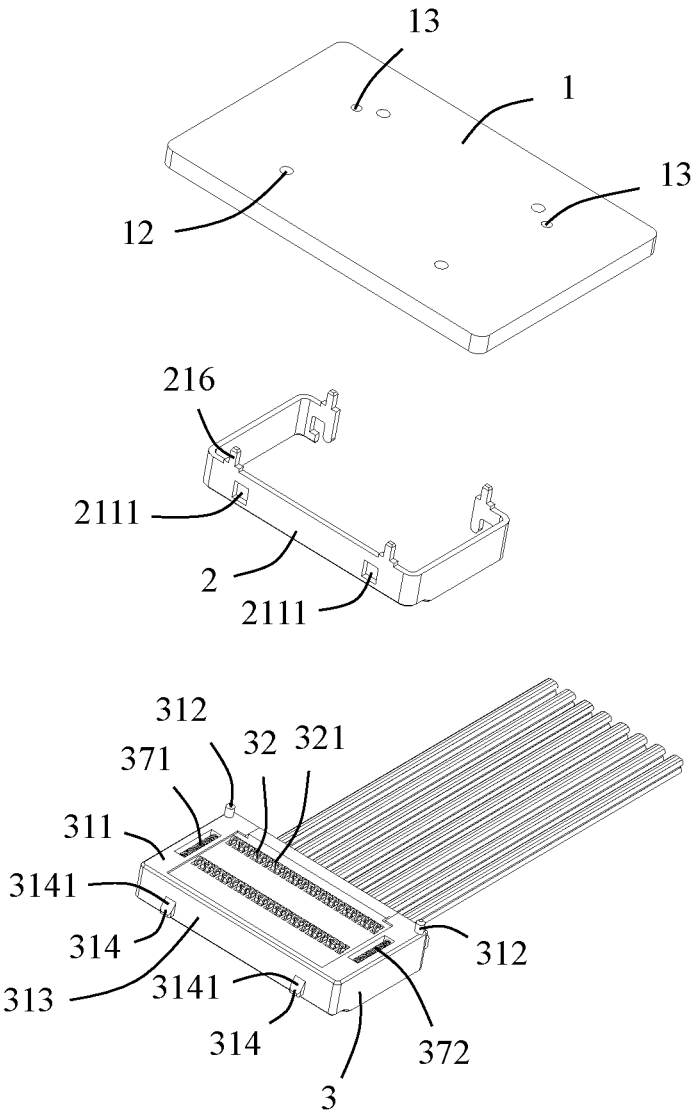
FIG. 4 is a perspective exploded view of FIG. 3 from another angle.
Figure 8:
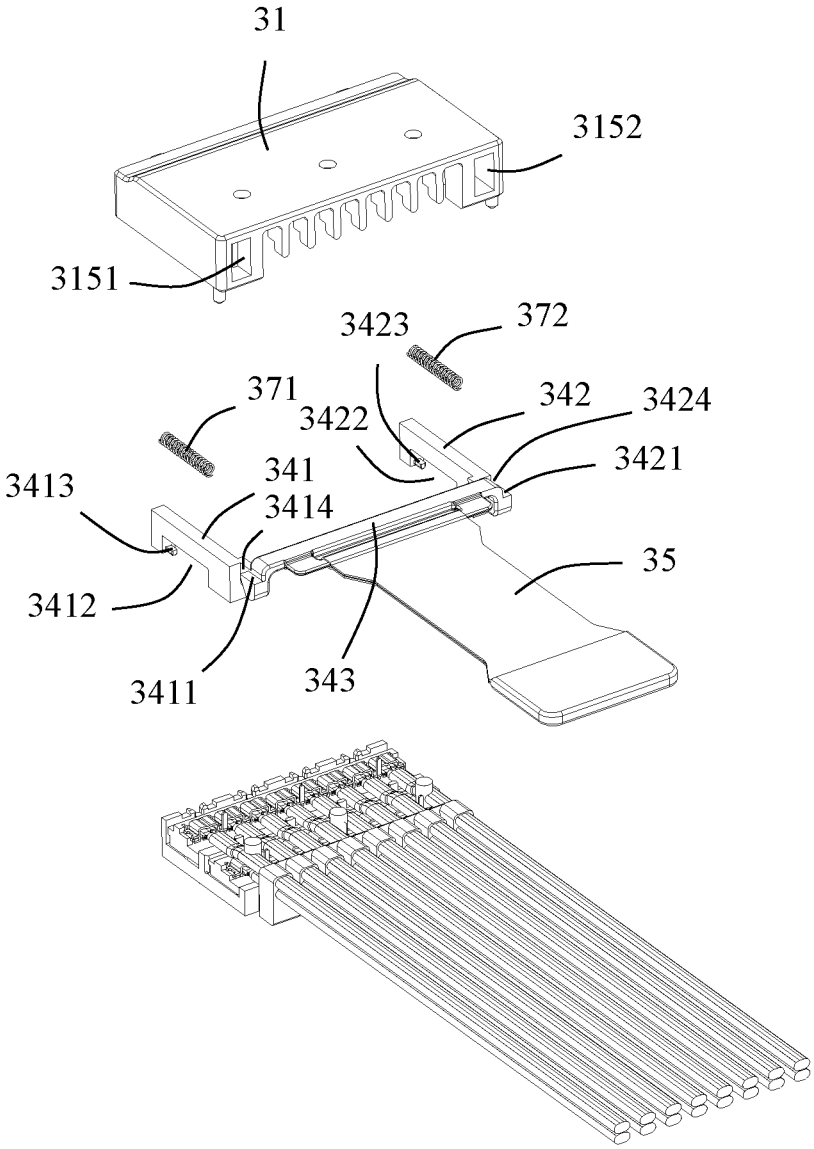
FIG. 8 is a further perspective exploded view of FIG. 6.
Figure 9:
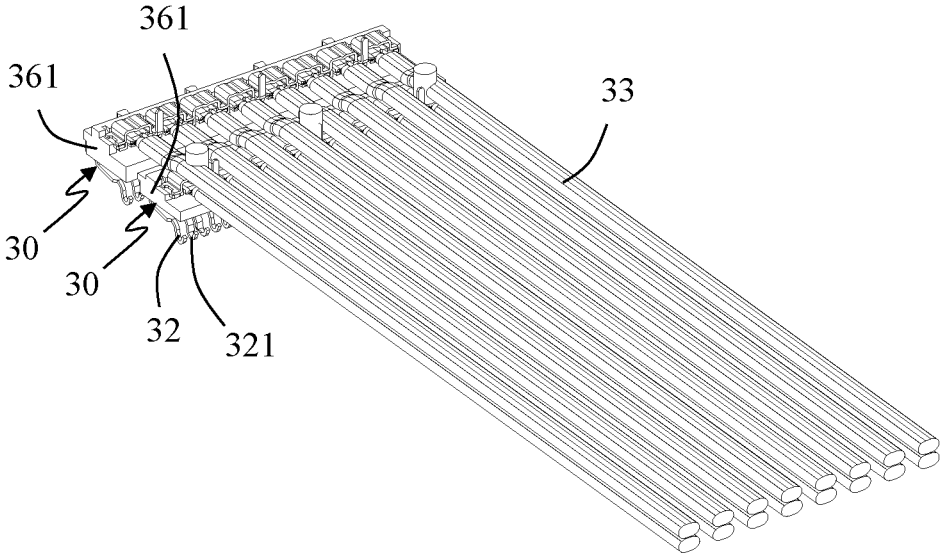
FIG. 9 is a perspective schematic view of a terminal module in FIG. 8.
Figure 10:
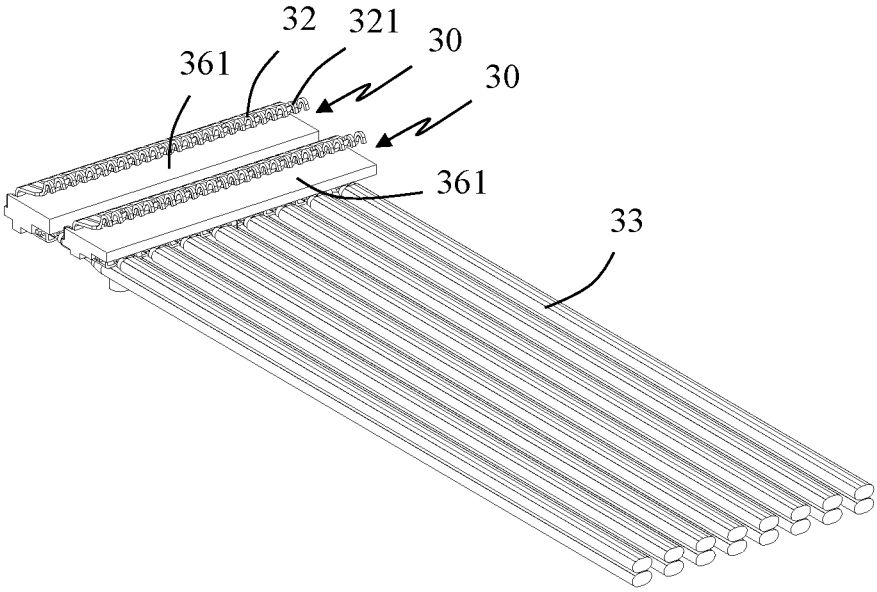
FIG. 10 is a perspective schematic view of FIG. 9 from another angle.

Referring to FIGS. 4 and 8, the insulating body 31 has a mounting surface 311 facing the circuit board 1 and a plurality of positioning posts 312 protruding from the mounting surface 311. The mounting surface 311 is used to resist against the circuit board 1. The positioning posts 312 are inserted into the corresponding positioning holes 13. In addition, the insulating body 31 further includes a front end surface 313 at a front end thereof and two locking protrusions 314 protruding forwardly from the front end surface 313. Each locking protrusion 314 includes an inclined guide surface 3141, so that the locking protrusion 314 can be slid into the corresponding through hole 2111 to fix the cable connector 3 on the mounting bracket 2. The insulating body 31 further includes a rear end surface 315 opposite to the front end surface 313 and a first sliding groove 3151 and a second sliding groove 3152 which extend through the rear end surface 315.

Figure 5:
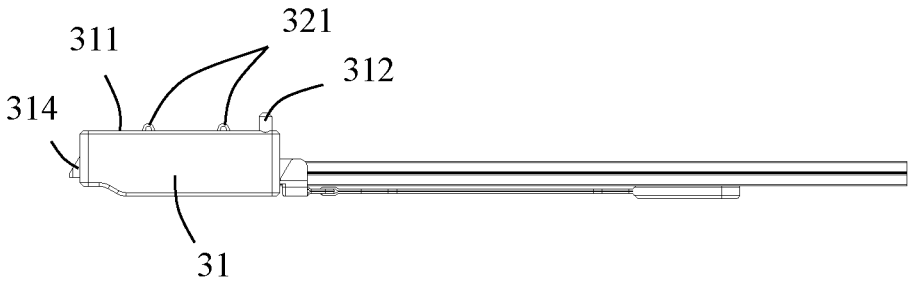
FIG. 5 is a front view of a cable connector in FIG. 4.
Figure 6:
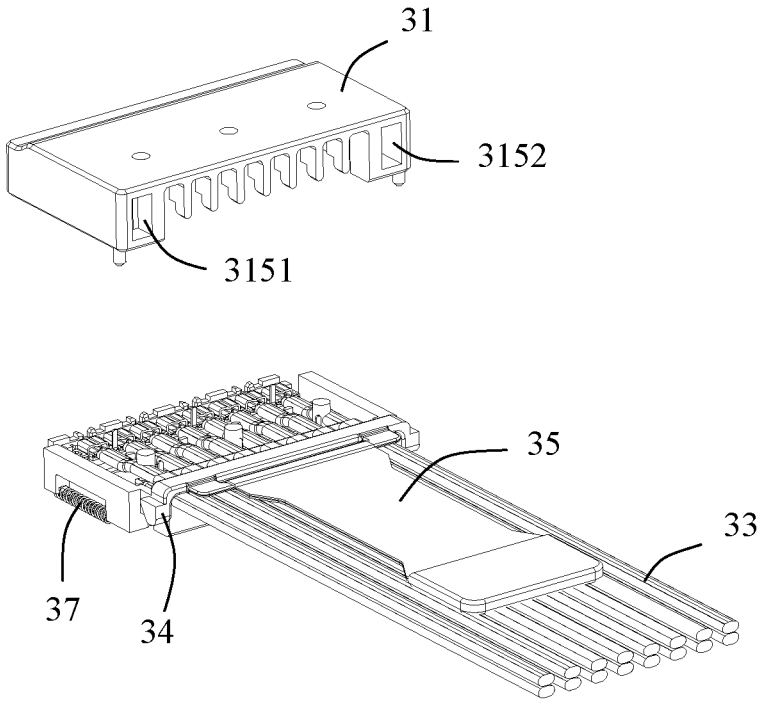
FIG. 6 is a partial perspective exploded view of the cable connector in FIG. 3.
Figure 7:
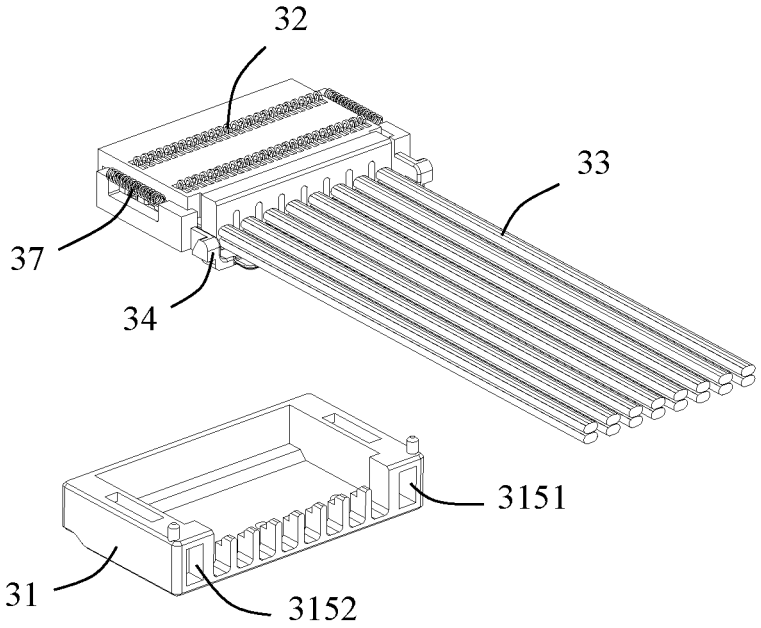
FIG. 7 is a partially exploded perspective view of FIG. 6 from another angle.

Referring to FIGS. 4 and 5, each conductive terminal 32 includes an elastic contact portion 321 protruding beyond the mounting surface 311. The elastic contact portions 321 are used to directly contact the conductive pads 11 of the circuit board 1 so as to establish electrical connection.

Referring to FIG. 8, the slider 34 includes a first arm portion 341, a second arm portion 342 parallel to the first arm portion 341, and a connecting portion 343 connecting the first arm portion 341 and the second arm portion 342. In the illustrated embodiment of the present disclosure, the force applying component 35 is a pull strap which is connected to the connecting portion 343. The pull strap is located above the cables 33. The cables 33 pass through the opening 217 and extend backwardly out of the mounting bracket 2. The connecting portion 343 at least partially protrudes from the rear end surface 315 to facilitate observation of the sliding and unlocking of the slider 34. The first arm portion 341 and the second arm portion 342 are correspondingly received in the first sliding groove 3151 and the second sliding groove 3152, respectively. In addition, the slider 34 is slidable in the first locking opening 2141 and the second locking opening 2151 at the same time. The first arm portion 341 includes a first locking portion 3411 which cooperates with the first stopper 2142. The second arm portion 342 includes a second locking portion 3421 which cooperates with the second stopper 2152.

In addition, the cable connector 3 further includes an elastic member 37 which cooperates with the slider 34. The elastic member 37 is capable of being compressed when the force applying component 35 pulls the slider 34 backwardly. The elastic member 37 is capable of providing a restoring force when the force applying component 35 releases the slider 34, thereby resetting the slider 34 forwardly. Specifically, in the illustrated embodiment of the present disclosure, the first arm portion 341 includes a first mounting groove 3412, and the second arm portion 342 includes a second mounting groove 3422. The elastic member 37 includes a first spring 371 received in the first mounting groove 3412 and a second spring 372 received in the second mounting groove 3422. In order to better position the elastic member 37, the first arm portion 341 is further provided with a first fixing rod 3413 at least partially inserted into the first spring 371, and the second arm portion 342 is also provided with a second fixing rod 3423 at least partially inserted into the second spring 372. In the illustrated embodiment of the present disclosure, the first locking portion 3411 includes a first unlocking groove 3414, and the second locking portion 3421 includes a second unlocking groove 3424 (see FIG. 8).

The force applying component 35 is capable of driving the slider 34 to slide between a locking position and an unlocking position. When the slider 34 is located at the locking position, the cable connector 3 is locked by the mounting bracket 2. Specifically, when the slider 34 is located at the locking position, the first stopper 2142 presses the first locking portion 3411 to prevent the first locking portion 3411 from moving upwardly. At the same time, the second stopper 2152 presses the second locking portion 3421 to prevent the second locking portion 3421 from moving upwardly. At this time, the cable connector 3 cannot be separated from the mounting bracket 2, which ensures the reliability of the electrical connection between the elastic contact portions 321 of the conductive terminals 32 and the conductive pads 11 of the circuit board 1.

When the slider 34 is moved from the locking position to the unlocking position under the pulling of the force applying component 35, the cable connector 3 is separable from the mounting bracket 2. Specifically, the first locking portion 3411 is separable from the first stopper 2142 (at this time, the first stopper 2142 corresponds to the first unlocking groove 3414), so that the first locking portion 3411 is movable upwardly. The second locking portion 3421 is separable from the second stopper 2152 (at this time, the second stopper 2152 corresponds to the second unlocking groove 3424), so that the second locking portion 3421 is movable upwardly. At this time, after the locking protrusions 314 are detached from the corresponding through holes 2111 by a tool, the cable connector 3 is detachable from the mounting bracket 2. Of course, in other embodiments, when the locking protrusions 314 and the through holes 2111 are not provided, this step can be omitted.

Compared with the prior art, the present disclosure directly installs the cable connector 3 to the circuit board 1 by providing the mounting bracket 2, thereby omitting a socket connector and reducing the volume and height of the connector assembly 100.

The above embodiments are only used to illustrate the present disclosure and not to limit the technical solutions described in the present disclosure. The understanding of this specification should be based on those skilled in the art. Descriptions of directions, although they have been described in detail in the above-mentioned embodiments of the present disclosure, those skilled in the art should understand that modifications or equivalent substitutions can still be made to the application, and all technical solutions and improvements that do not depart from the spirit and scope of the application should be covered by the claims of the application.

What is claimed is:

1. A connector assembly, comprising:

a circuit board having a plurality of conductive pads;

a cable connector comprising an insulating body, a plurality of conductive terminals and a plurality of cables connected to the conductive terminals, the insulating body comprising a mounting surface facing the circuit board, each conductive terminal comprising an elastic contact portion protruding beyond the mounting surface; and a mounting bracket fixed to the circuit board, the mounting bracket comprising a frame portion and an installation space at least partially enclosed by the frame portion;

wherein the cable connector is at least partially received in the installation space so that the elastic contact portions are in contact with the conductive pads;

wherein the cable connector further comprises a slider capable of sliding relative to the insulating body between a locking position and an unlocking position;

wherein when the slider is located at the locking position, the cable connector is locked by the mounting bracket;

wherein when the slider is located at the unlocking position, the cable connector is separable from the mounting bracket;

wherein the frame portion comprises a first locking opening and a first stopper located above the first locking opening, the slider is slidable in the first locking opening, the slider comprises a first locking portion;

wherein when the slider is located at the locking position, the first stopper prevents the first locking portion from moving upwardly; and wherein when the slider is in the unlocking position, the first locking portion is separated from the first stopper so that the first locking portion is movable upwardly.

2. The connector assembly according to claim 1, wherein the cable connector further comprises a force applying component connected with the slider, and the force applying component is capable of driving the slider to slide between the locking position and the unlocking position.

3. The connector assembly according to claim 1, wherein the frame portion comprises a first extension wall, and the first extension wall comprises the first locking opening and the first stopper.

4. The connector assembly according to claim 3, wherein the frame portion comprises a second extension wall extending opposite to the first extension wall, the second extension wall comprises a second locking opening and a second stopper located above the second locking opening, the slider is slidable in the first locking opening and the second locking opening at the same time, the slider comprises a second locking portion;

wherein when the slider is located at the locking position, the second stopper prevents the second locking portion from moving upwardly; and wherein when the slider is located at the unlocking position, the second locking portion is separated from the second stopper so that the second locking portion is movable upwardly.

5. The connector assembly according to claim 4, wherein the frame portion comprises an opening located between the first extension wall and the second extension wall, and the cables pass through the opening so as to extend out of the mounting bracket.

6. A connector assembly, comprising:

a circuit board having a plurality of conductive pads;

a cable connector comprising an insulating body, a plurality of conductive terminals and a plurality of cables connected to the conductive terminals, the insulating body comprising a mounting surface facing the circuit board, each conductive terminal comprising an elastic contact portion protruding beyond the mounting surface; and a mounting bracket fixed to the circuit board, the mounting bracket comprising a frame portion and an installation space at least partially enclosed by the frame portion;

wherein the cable connector is at least partially received in the installation space so that the elastic contact portions are in contact with the conductive pads;

wherein the cable connector further comprises a slider capable of sliding relative to the insulating body and a force applying component connected with the slider, the force applying component is capable of driving the slider to slide between a locking position and an unlocking position;

wherein when the slider is located at the locking position, the cable connector is locked by the mounting bracket;

wherein when the slider is located at the unlocking position, the cable connector is separable from the mounting bracket; and wherein the cable connector comprises an elastic member mating with the slider, the elastic member is capable of being compressed when the force applying component pulls the slider, and the elastic member is capable of providing a restoring force so as to reset the slider when the force applying component releases the slider.

7. The connector assembly according to claim 6, wherein the slider comprises a first arm portion, a second arm portion parallel to the first arm portion, and a connecting portion connecting the first arm portion and the second arm portion, the force applying component is a pull strap and is connected with the connecting portion, the pull strap is located above the cables, the insulating body comprises a first sliding groove to receive the first arm portion and a second sliding groove to receive the second arm portion.

8. The connector assembly according to claim 7, wherein the first arm portion comprises a first mounting groove, the second arm portion comprises a second mounting groove, and the elastic member comprises a first spring received in the first mounting groove and a second spring received in the second mounting groove.

9. The connector assembly according to claim 1, wherein the frame portion comprises a through hole, and the insulating body comprises a locking protrusion locked in the through hole.

10. The connector assembly according to claim 1, wherein the circuit board comprises a plurality of positioning holes, and the insulating body comprises a plurality of positioning posts received in the positioning holes.

11. A connector assembly, comprising:

a circuit board having a plurality of conductive pads;

a cable connector comprising an insulating body, a plurality of conductive terminals and a plurality of cables electrically connected with the conductive terminals, the insulating body comprising a mounting surface facing the circuit board, each conductive terminal comprising an elastic contact portion protruding beyond the mounting surface; and a mounting bracket fixed to the circuit board, the mounting bracket comprising a frame portion and an installation space at least partially enclosed by the frame portion;

wherein the cable connector is at least partially mounted into the installation space along a first direction so that the elastic contact portions are in contact with the conductive pads;

wherein the cable connector comprises a slider slidable along a second direction perpendicular to the first direction, and the slider is slidable relative to the insulating body between a locking position where the cable connector is locked by the mounting bracket and an unlocking position where the cable connector is separable from the mounting bracket;

wherein the cable connector further comprises a force applying component connected with the slider, the force applying component is capable of driving the slider to slide between the locking position and the unlocking position; and wherein the cable connector comprises an elastic member mating with the slider, the elastic member is capable of being compressed when the force applying component pulls the slider, and the elastic member is capable of providing a restoring force so as to reset the slider when the force applying component releases the slider.

12. The connector assembly according to claim 11, wherein the frame portion comprises a first extension wall, the first extension wall comprises a first locking opening and a first stopper located above the first locking opening, the slider is slidable in the first locking opening, the slider comprises a first locking portion;

wherein when the slider is located at the locking position, the first stopper prevents the first locking portion from moving upwardly; and wherein when the slider is in the unlocking position, the first locking portion is separated from the first stopper so that the first locking portion is movable upwardly.

13. The connector assembly according to claim 12, wherein the frame portion comprises a second extension wall extending opposite to the first extension wall, the second extension wall comprises a second locking opening and a second stopper located above the second locking opening, the slider is slidable in the first locking opening and the second locking opening at the same time, the slider comprises a second locking portion;

wherein when the slider is located at the locking position, the second stopper prevents the second locking portion from moving upwardly; and wherein when the slider is located at the unlocking position, the second locking portion is separated from the second stopper so that the second locking portion is movable upwardly.

14. The connector assembly according to claim 13, wherein the frame portion comprises an opening located between the first extension wall and the second extension wall, and the cables pass through the opening so as to extend out of the mounting bracket.

15. The connector assembly according to claim 11, wherein the slider comprises a first arm portion, a second arm portion parallel to the first arm portion, and a connecting portion connecting the first arm portion and the second arm portion, the force applying component is a pull strap and is connected with the connecting portion, the pull strap is located above the cables, the insulating body comprises a first sliding groove to receive the first arm portion and a second sliding groove to receive the second arm portion.

16. The connector assembly according to claim 15, wherein the first arm portion comprises a first mounting groove, the second arm portion comprises a second mounting groove, and the elastic member comprises a first spring received in the first mounting groove and a second spring received in the second mounting groove.

17. The connector assembly according to claim 11, wherein the frame portion comprises a through hole, and the insulating body comprises a locking protrusion locked in the through hole.

18. The connector assembly according to claim 11, wherein the circuit board comprises a plurality of positioning holes, and the insulating body comprises a plurality of positioning posts fixed in the positioning holes.

* * * * *